US005640729A

United States Patent [19]

Mariño

[11] Patent Number: 5,640,729

[45] Date of Patent: Jun. 24, 1997

[54] ERGONOMIC MECHANISM FOR USE IN HOSPITALS

[76] Inventor: Mario Héctor Silvio Mariño, San Martín 686 - 7th. fl. of. 72, Buenos Aires, Argentina

[21] Appl. No.: 389,147

[22] Filed: Feb. 15, 1995

[30] Foreign Application Priority Data

Mar. 3, 1994 [AR] Argentina ..... 327570

[51] Int. Cl.[6] ..... A61G 7/008

[52] U.S. Cl. ..... 5/607; 5/612; 5/609

[58] Field of Search ..... 5/612, 607, 609

[56] References Cited

U.S. PATENT DOCUMENTS

| | | | |
|---|---|---|---|
| 4,084,274 | 4/1978 | Willis et al. | 5/609 |
| 4,225,988 | 10/1980 | Cary et al. | 5/607 |
| 4,658,450 | 4/1987 | Thompson | 5/607 |
| 5,224,228 | 7/1993 | Larrimore | 5/607 X |
| 5,303,437 | 4/1994 | Hung | 5/607 X |

*Primary Examiner*—Michael F. Trettel
*Attorney, Agent, or Firm*—J. Sanchelima

[57] ABSTRACT

An adjustable bed for patients requiring periodic changes of their resting positions. A rectangular frame with two pairs of lateral members are axle members longitudinally disposed along the frame. One or more supporting wings that are pivotally mounted to the axle members. A flexible sheet is mounted over the concave portion of the wings to support the patient. A mechanism for causing the wings to rotate is cooperatively coupled to the wings. Either mechanical, hydraulic or other equivalent mechanisms can be used to impart the rotation to the wings.

4 Claims, 3 Drawing Sheets

ERGONOMIC MECHANISM FOR USE IN HOSPITALS

II. BACKGROUND OF THE INVENTION

1. Field of the Invention

The present invention relates to movable beds to be used with patients that require unusual positioning of their bodies when at rest, and in particular, to those beds that include flexible sheet members to suspend the patients with minimal pressure on critical parts of their bodies.

2. Description of the Related Art

Many designs of beds, including those used in hospitals, have been designed in the past. One of these beds is described in Larrimore's U.S. Pat. No. 5,224,228 issued in 1993. However, it fails to disclose the use of a flexible sheet to suspend a patient at predetermined and selectable positions.

III. SUMMARY OF THE INVENTION

It is one of the main objects of the present invention to provide a bed for use by patients with body injuries that require their position to be adjusted by suspending them in a substantially horizontal plane with minimum pressure in their sensitive affected areas, by displacing the patient with an angular rotation.

It is another object of this invention to provide a therapeutical bed that includes a flexible sheet to suspend a patient that permits a better result turning her or his to any of his or her sides.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
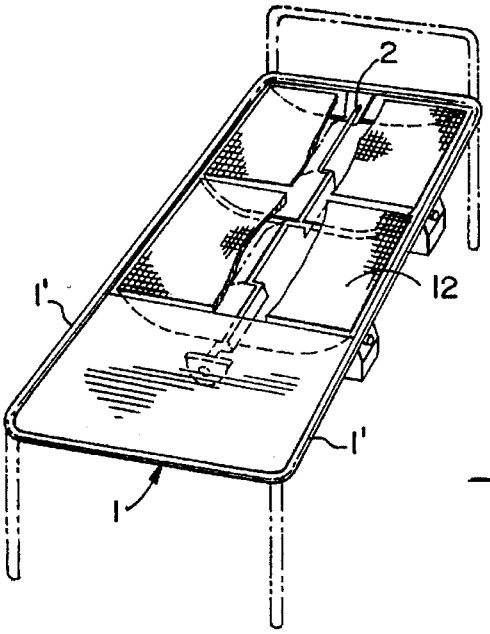
FIG. 1 is an isometric representation of a bed that incorporates the features of the present invention.
Figure 2:
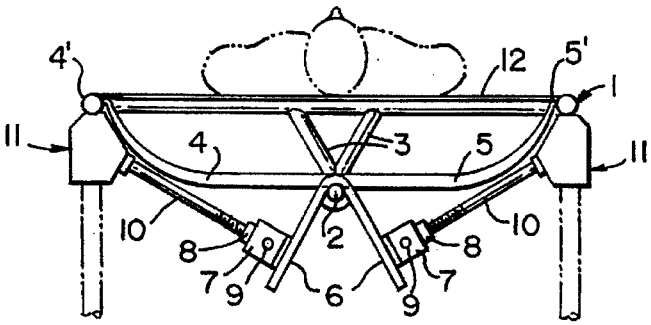
FIG. 2 is an end view of the bed shown in FIG. 1.

Referring now to the drawings, it can be observed that the present invention basically includes rectangular frame 1 with lateral members 1', longitudinal and centrally disposed axle 2 rotably supported by supporting assembly 3 and wing assemblies 4 and 5 that are adjacent to each other and pivotally mounted to axle 2. Wings 4 and 5 extend outwardly and include outer edges 4' and 5' that do not extend beyond the lateral boundaries of frame 1.

Flexible sheet members 12 are mounted to edges 4' and 5' so that a patient's body can be suspended away from wings 4 and 5.

Figure 3:
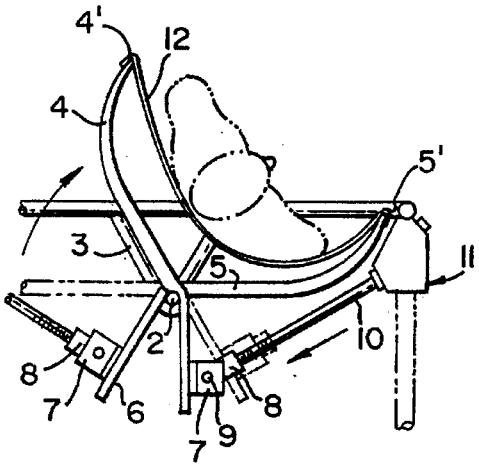
FIG. 3 is similar to FIG. 2 showing the patient rotated and resting on his right side.
Figure 4:
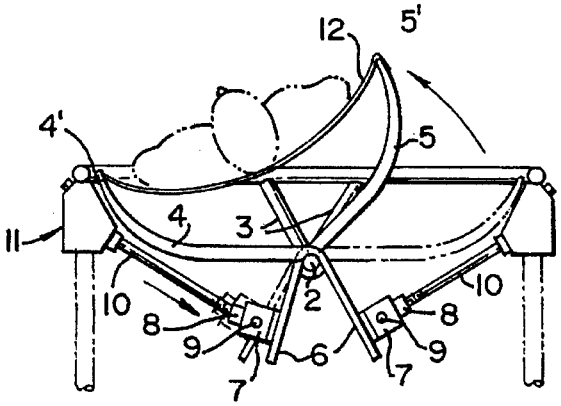
FIG. 4 is similar to FIGS. 2 and 3 showing the patient rotated approximately 45 degrees and resting partially on his left side.
Figure 5:
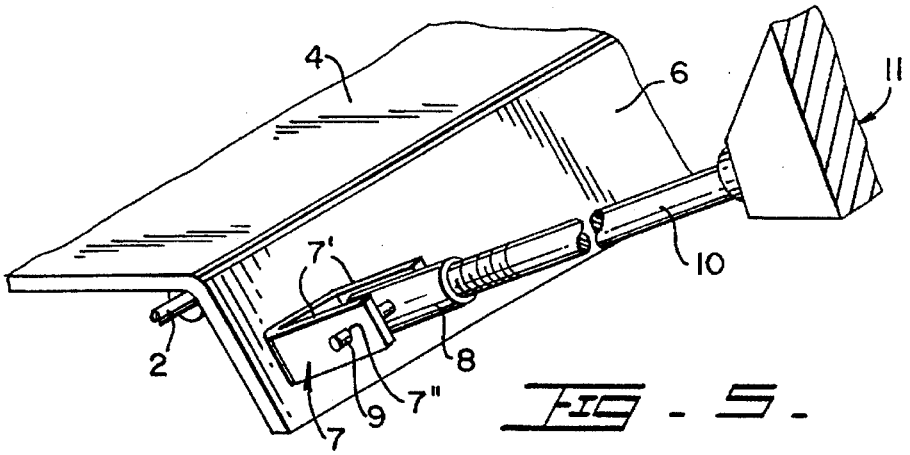
FIG. 5 shows an isometric partial view of the mechanism used in the preferred embodiment to adjust the position of the wings.
Figure 6:
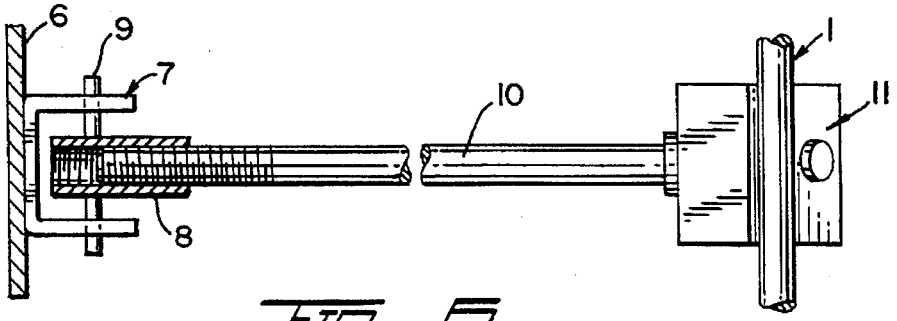
FIG. 6 is a top view of the mechanism illustrated in the previous figure.

As an extension to wings 4 and 5, and rigidly connected thereto, are ends 6 designed to receive the rotational force that will be transmitted to wings 4 and 5. Rigidly mounted on ends 6 are bracket members 7 that include walls 7' that are mounted perpendicularly with respect to end 6, as best seen in FIG. 5. Internally threaded member 8 includes pins 9 rigidly mounted on opposite side of member 8 and in colinear arrangement. Pins 9 are joinable by holes 7" so that member 8 is allowed to swivel. Worm screw member 10 is cooperatively received by the internal thread of member 8. Worm screw member 10 is rotated, in the preferred embodiment, with motor reducer assembly 11, causing it to advance or retreat within threaded member 8 and thus transmitting a rotational force to ends 6, as shown in FIGS. 3; 4; 5 and 6. Other equivalent mechanisms, such as hydraulic mechanisms, can also be used to impart the necessary rotational force on ends 6.

Figure 7:
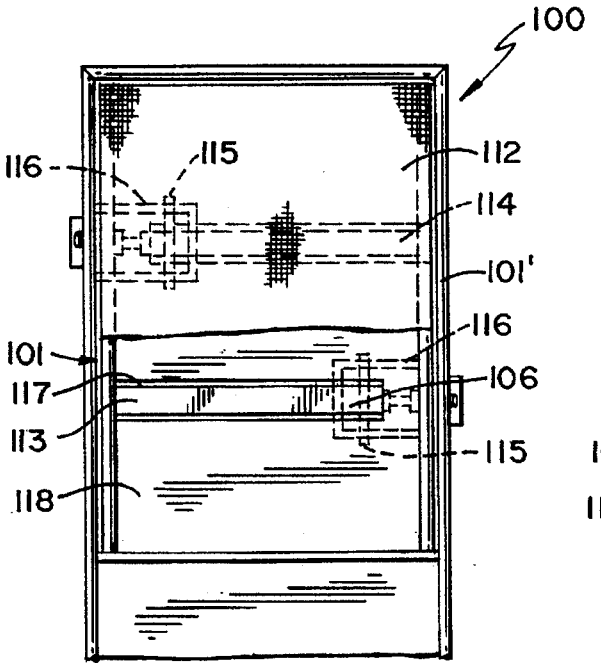
FIG. 7 is a top partial cross-sectional view of an alternate embodiment for a bed, subject of the present application, with wings that include a pivoting axles positioned substantially along the longitudinal edges of the bed.
Figure 8:
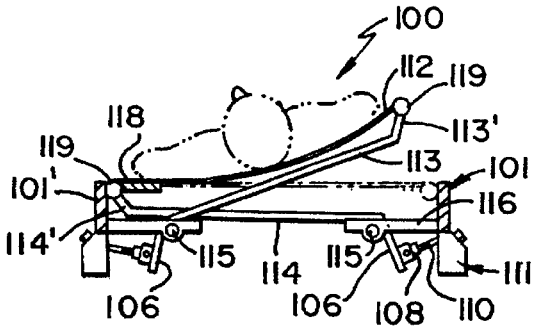
FIG. 8 represents an end view of the alternate embodiment shown in the previous figure where a patient (in phantom) has been rotated on his/her left side.

An alternative embodiment 100 is shown in FIGS. 7 and 8. Wings 4 and 5 have been replaced with arms 113 and 114 that also include ends 106 on which the necessary rotational force is applied. Arms 113 and 114 are pivotally mounted to axles 115 that are longitudinally disposed parallel to the lateral members 101' of frame 101 and is supported by stirrups 116, which are in turn rigidly mounted to frame 101. Distal ends 113' and 114' of arms 113 and 114, respectively, protrude upwardly through slots 117 on bed 118. Ends 113' and 114' are rigidly mounted to rods 119 which in turn support the lateral edges of flexible sheet 112. Flexible sheet 112 supports the patient's body. In this manner, when ends 106 are rotated, arms 113 and/or 114 are projected upwardly or downwardly, thereby axially moving the patient's position to his or her side, as best seen in FIG. 8.

Motor reducer assembly 111 provides the rotational force to worm screw 110 which in turn advances or retreats within internal threaded member 108, similar to the preferred embodiment. With a relatively small fulcrum point distance or torque, the required displacement of member 108 is relatively small. Other equivalent means for imparting the required rotational force to ends 106 can also be used, such as hydraulic means.

Figure 9:
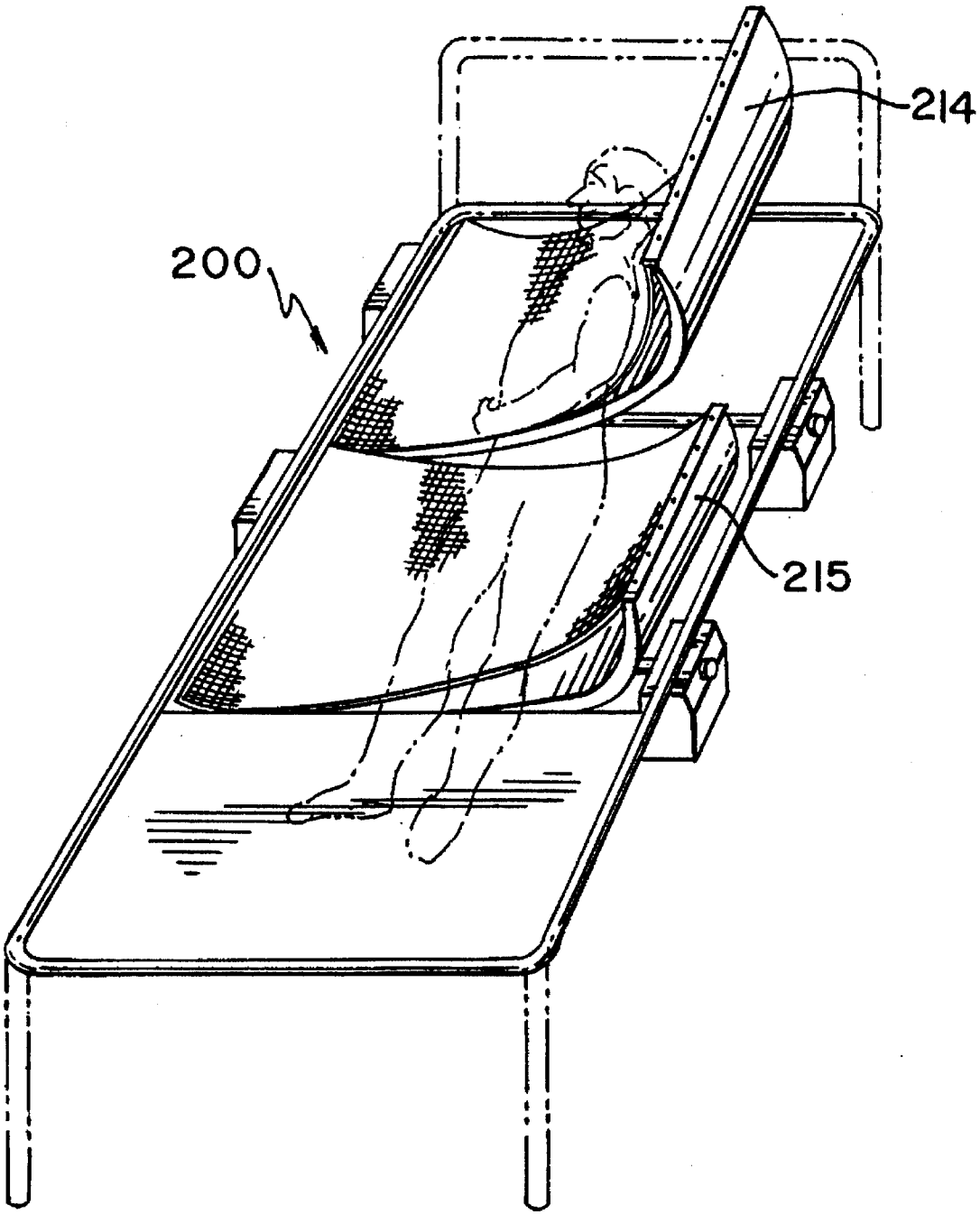
FIG. 9 is an isometric view from the top of another embodiment showed in FIG. 1, and illustrating another mechanism of the present invention.

In FIG. 9, still another embodiment 200 is shown for specific patient's needs that require axial rotation of the patient of different degrees. It can be observed that wing 214 is at different angle than wing 215 thus providing another set of possibilities for the user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An adjustable bed, comprising:

A) rectangular frame means having an upperside and an underside and a plurality of leg members resting on a supporting surface;

B) axle means longitudinally and centrally disposed with respect to said rectangular frame means at a spaced apart relationship between said frame means and said supporting surface;

C) first and second supporting wings means having each a concave portion and each having first and second ends, said first ends being pivotally mounted to said axle means;

D) first flexible sheet members mounted over said concave portion and attached to said second ends; and E) first and second means for moving said first and second supporting wing means, respectively, so that a user's body is selectively moved substantially around his or her longitudinal axis.

2. The adjustable bed set forth in claim 1 further including:

F) third and fourth supporting wing means having each a concave portion and each having third and fourth ends, said third ends being pivotally mounted to said axle means;

G) second flexible sheet member mounted over said concave portion and attached to said fourth ends; and H) third and fourth means for moving said third and fourth supporting wing means, respectively, so that a user's body is selectively moved substantially around his or her longitudinal axis.

3. The adjustable bed set forth in claim 2 wherein said first, second, third and fourth supporting wing means include a longitudinal edge at said first and third ends that extends substantially perpendicularly thereto and said first, second, third and fourth moving means including each worm screw means pivotally mounted to said longitudinal edges, and said first, second, third and fourth moving means include each a motor member to impart a rotational force to said worm screw means.

4. The adjustable bed set forth in claim 3 wherein said motor member is a motor reducer.

* * * * *